US011505941B2

(12) United States Patent
Scheevel et al.

(10) Patent No.: US 11,505,941 B2
(45) Date of Patent: Nov. 22, 2022

(54) CEILING TILE SYSTEM

(71) Applicant: Lumicor Inc., Renton, WA (US)

(72) Inventors: Brad Scheevel, Great Falls, MT (US); Janell Dastrup, Bellevue, WA (US); Todd Darrow, Edmonds, WA (US); Joe Bauer, Seattle, WA (US)

(73) Assignee: Lumicor Inc., Renton, WA (US)

( * ) Notice: Subject to any disclaimer, the term of this patent is extended or adjusted under 35 U.S.C. 154(b) by 0 days.

(21) Appl. No.: 17/190,291

(22) Filed: Mar. 2, 2021

(65) Prior Publication Data

US 2022/0282481 A1 Sep. 8, 2022

(51) Int. Cl.
*E04B 9/04* (2006.01)

(52) U.S. Cl.
CPC ..... *E04B 9/0464* (2013.01); *E04B 2103/00* (2013.01)

(58) Field of Classification Search
CPC .... E04B 2103/04; E04B 9/0464; E04B 9/345; E04B 9/34; E04B 9/001
See application file for complete search history.

(56) References Cited

U.S. PATENT DOCUMENTS

| | | | | |
|---|---|---|---|---|
| 9,163,402 | B2 * | 10/2015 | Kabatsi | E04B 9/00 |
| 9,663,949 | B1 * | 5/2017 | Caste | E04B 9/0428 |
| 10,672,376 | B1 * | 6/2020 | Pickens | F21V 33/006 |
| 2019/0186132 | A1 * | 6/2019 | Knoblauch | E04B 9/28 |
| 2020/0123772 | A1 * | 4/2020 | Adams | E04B 9/006 |
| 2020/0370292 | A1 * | 11/2020 | Immordino | E04B 9/366 |
| 2021/0054991 | A1 * | 2/2021 | Stary | E04C 2/38 |
| 2022/0154462 | A1 * | 5/2022 | Monier | E04B 9/0414 |

* cited by examiner

*Primary Examiner* — Gisele D Ford
(74) *Attorney, Agent, or Firm* — Jay Pattumudi; Lucosky Brookman, LLP

(57) ABSTRACT

Ceiling tile system for acoustic modification.

6 Claims, 6 Drawing Sheets

CEILING TILE SYSTEM

CROSS-REFERENCES TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND

When considering the design of the interior of a large space, acoustics is always a consideration. Sound must be controlled to make large space usable. Suspended ceilings, or lay-in ceilings, with Acoustic Ceiling Tiles (ACT) are commonly used in these types of spaces. Here ACT are placed onto a stick-built grid system. A stick-built grid system is shown in FIG. 1. This type of system is versatile, durable, and cost effective. In addition, ceiling tiles can be removed without damage to the system so that systems above the ceiling can be maintained.

More modern buildings have started using polyethylene terephthalate, also utilized in a form of PET Felt. PET Felt is strong, sturdy, and better at controlling acoustics than older acoustic tiles. It is considered attractive and suited to trends in interior designs. However, to use PET Felt, existing stick-built grid systems must be replaced with hangers that can support the PET felt. It can become expensive to retrofit a space for modernization. The invention disclosed herein provides system and method to utilize PET Felt in existing stick-built grid systems.

BRIEF DESCRIPTION OF INVENTION

The invention described herein is PET felt tile system that fits into existing stick-built grid systems.

DESCRIPTION OF THE SEVERAL VIEWS OF THE DRAWINGS

Other features and advantages of the present invention will become apparent in the following detailed descriptions of the preferred embodiment with reference to the accompanying drawing.

DETAILED DESCRIPTION OF THE INVENTION

Figure 1:
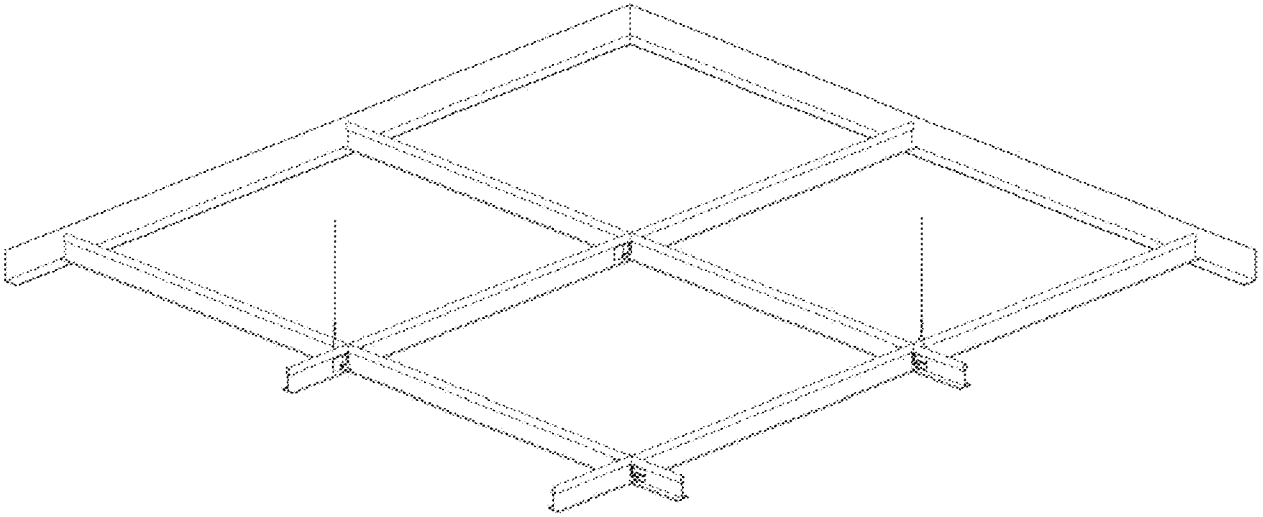
Fig.1 (prior art)
FIG. 1 shows a typical ACT and stick-built grid system.

In the following detailed description, reference is made to the accompanying drawings, which form a part hereof. In the drawings, the use of similar or the same symbols in different drawings typically indicates similar or identical items, unless context dictates otherwise. The illustrative embodiments described in the detailed description, drawings, and claims are not meant to be limiting. Other embodiments may be utilized, and other changes may be made, without departing from the spirit or scope of the subject matter presented here.

One skilled in the art will recognize that the herein described components (e.g., operations), devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components (e.g., operations), devices, and objects should not be taken as limiting.

The present application uses formal outline headings for clarity of presentation. However, it is to be understood that the outline headings are for presentation purposes, and that different types of subject matter may be discussed throughout the application (e.g., device(s)/structure(s) may be described under process(es)/operations heading(s) and/or process(es)/operations may be discussed under structure(s)/process(es) headings; and/or descriptions of single topics may span two or more topic headings). Hence, the use of the formal outline headings is not intended to be in any way limiting. Given by way of overview, illustrative embodiments include a ceiling tile system (100) and a method to hang same within a stick-built grid system.

Referring to FIGS. 2, 2A, 2B, and 3, in an embodiment, the ceiling tile system (100) is comprised of a tile (200) that defines at least one slot (210) and at least one blade (300). In an embodiment, the tile (200) is sized to operably mate within one grid of a stick-built grid system. In an embodiment, operably mate within one grid of a stick-built grid support system means that the tile (200) fits within a grid without need for adhesive, clip, hanger, or other attachment method or mechanism. In one embodiment, the tile (200) is substantially rectangular and has at least one of the following dimensions:

| | | |
|---|---|---|
| 12" × 12" | 12" × 24" | 24" × 24" |
| 24" × 24" | 24" × 48" | 24" × 60" |
| 24" × 72" | 30" × 30" | 20" × 60" |
| 30" × 60" | 60" × 60" | 48" × 48" |

In one embodiment, the ceiling tile system (100) is made from PET. In other embodiments, the ceiling tile system (100) may be made from wood, steel, plastic, or any other material or combination of materials that support the functionality of the ceiling tile system (100).

Figure 2:
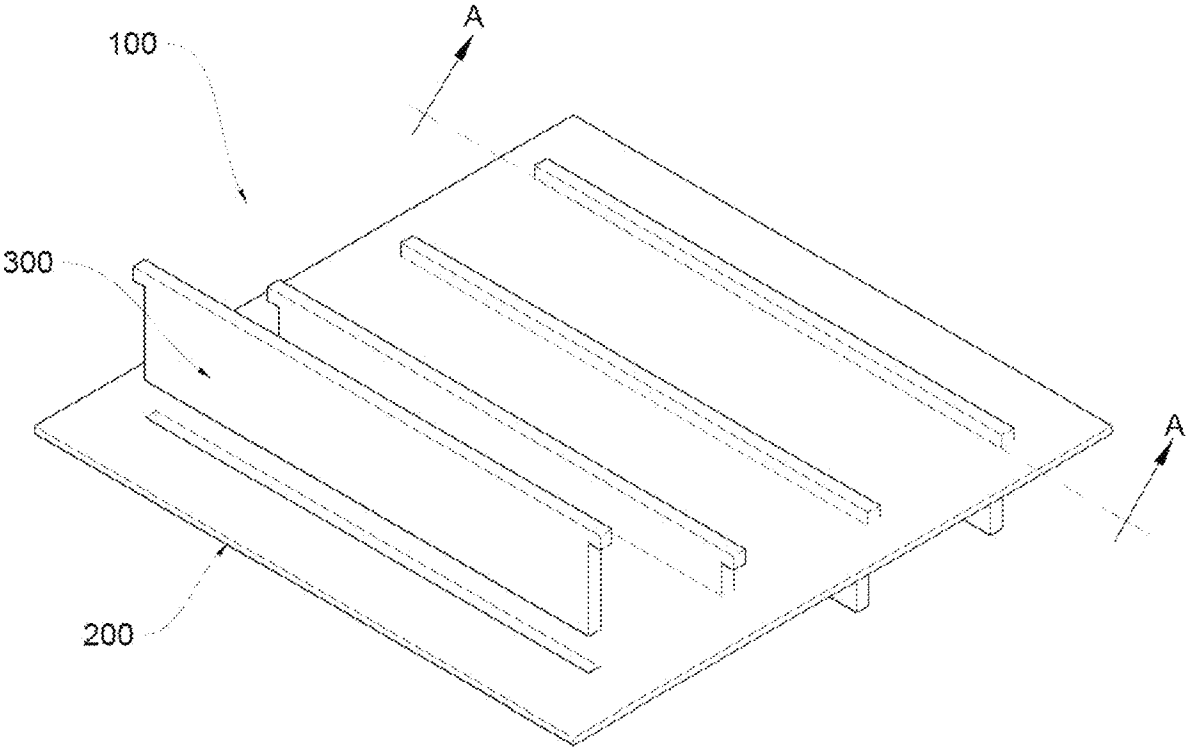
FIG. 2 is a top, perspective view of a ceiling tile system.
Figures 2A, 2B:
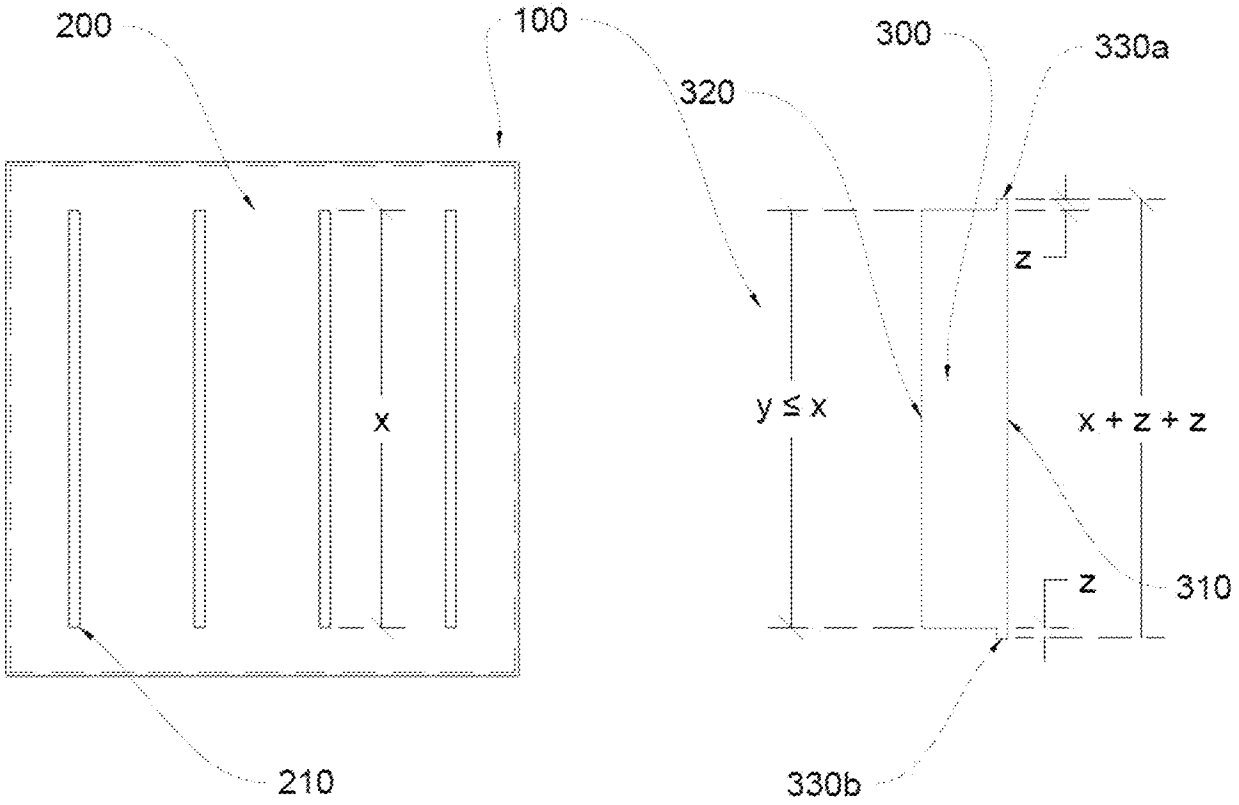
FIG. 2A shows a top view of an exemplary tile.
FIG. 2B shows a side view of an exemplary blade.
Figure 3:
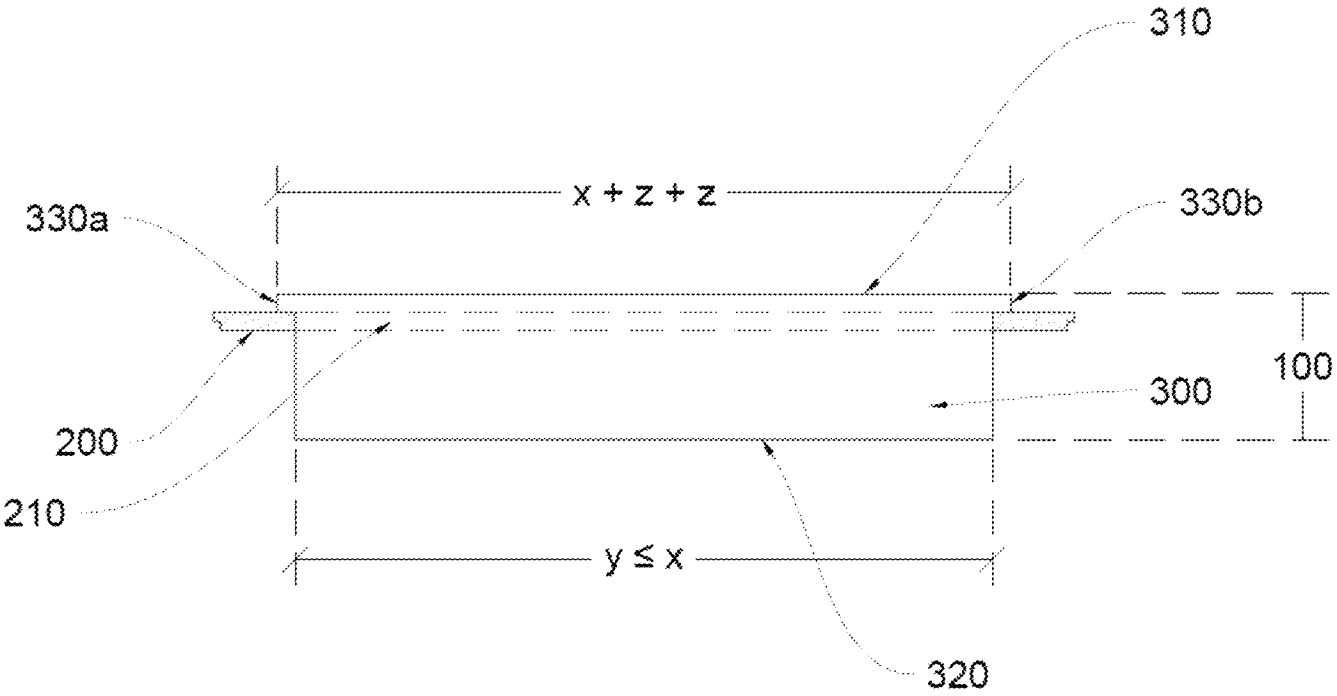
FIG. 3 shows a cut-away view of a tile and blade taken from A-A of FIG. 2.
Figure 4:
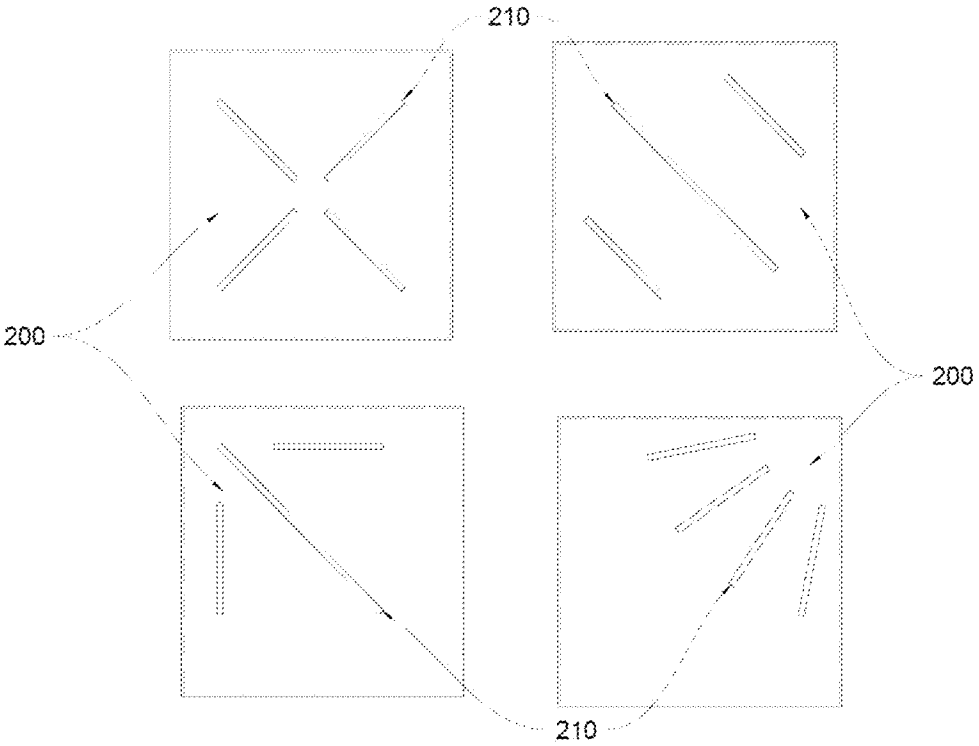
FIG. 4 shows several slot configurations.

While FIG. 2A shows a tile (200) having a plurality of slots (210) in a linear configuration, it will be obvious that slots (210) may be provided in any configuration. For exemplary purposes, and not exclusively, FIG. 4 shows several tiles (200) where slots (210) are placed in different configurations.

The blade (300) is comprised of at least a near side (310) and a far side (320). The length of the far side (320) is equal or less then the length of the slot (210) so that the blade (300) can extend, at least partially, through the slot (210). The length of the near side (310) is longer than the length of the slot (210) so that the blade (300) is prevented from extending completely through the slot (210). The blade (300) sits on the tile (200) so that, at least the near side (310) extends over the tile (200). In an exemplary embodiment, the slot (210) has a length of x. The far side (320) has a length of y where y≤x. The near side (310) has a length x+z+z.

Figure 5:
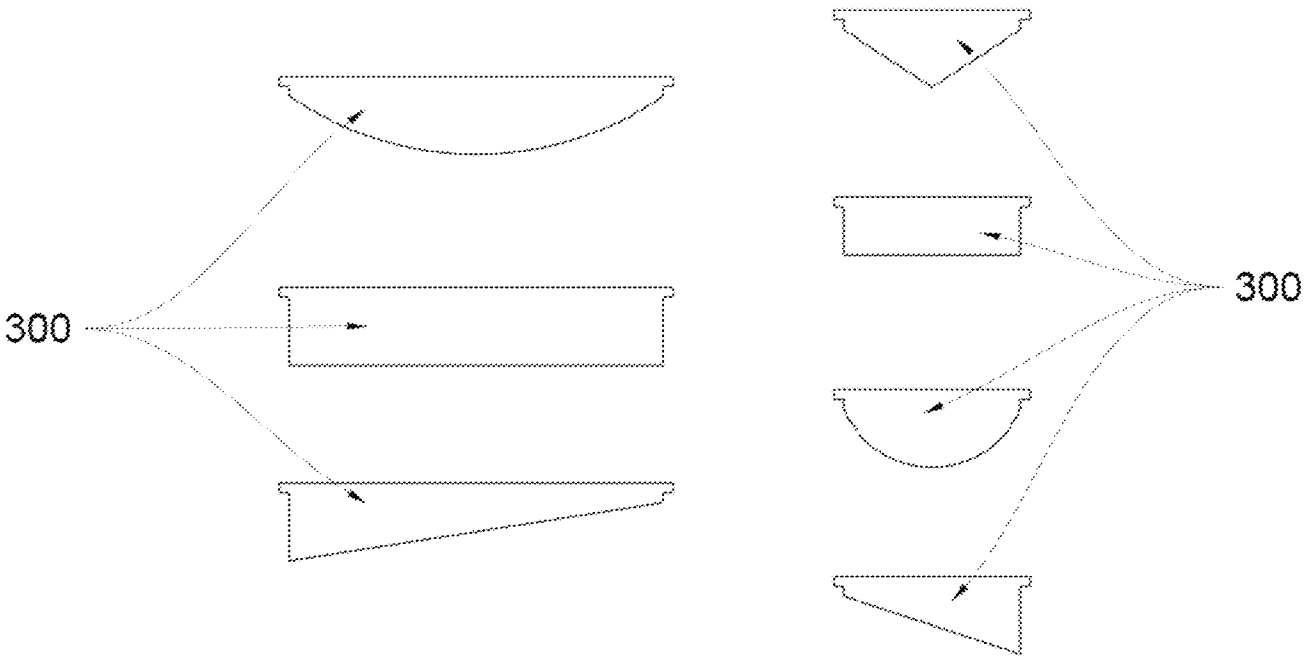
FIG. 5 shows several blade shapes.

While the blade (300) is shown, generally, as a quadrilateral in FIG. 2B, it will be obvious that the shape of the blade (300) can be of any shape. For exemplary purposes, and not exclusively, FIG. 5 shows blades (300) having different shapes; however, keeping the length parameters discussed above.

In a method to use the ceiling tile system (100) where the at least one ceiling tile (200) is placed within a grid of a stick-built grid system. In another method to use the ceiling tile system (100), a blade (300) is inserted through at least one slot (210).

The invention claimed is:

1. A ceiling tile system comprising:

a tile that defines at least one slot; and at least one blade comprising at least one near side and at least one far side, the at least one near side having a near side length longer than a length of the slot; and the at least one far side having a far side length equal or less than the length of the slot, wherein the blade operably mates through the slot of the tile by having the far side length allowing the blade to extend, at least partially through the slot and by having the near side length preventing the blade from extending completely through the slot such that a connection between the blade and the slot is allowed and thereby allowing no need for a fastener or an adhesive; and the tile is sized to operably mate within one grid of a stick-built grid system such that a connection between the tile and the one grid is allowed and thereby allowing no need for a fastener or an adhesive.

2. The ceiling tile system of claim 1, wherein the tile or the blade is made from PET or both the tile and the blade are made from PET.

3. A method of using the ceiling tile system of claim 1, further including a step of placing the tile within the at least one grid of a stick-built grid system.

4. The method of claim 3, wherein the tile or the blade is made from PET or both the tile and the blade are made from PET.

5. A method of using the ceiling tile system of claim 1, further including a step of inserting the blade through the at least one slot.

6. The method of claim 5, wherein the tile or the blade is made from PET or both the tile and the blade are made from PET.

* * * * *